US008567330B2

(12) United States Patent
Thomas et al.

(10) Patent No.: US 8,567,330 B2
(45) Date of Patent: Oct. 29, 2013

(54) METHOD OF ASSEMBLING AND INSTALLING A VERY LARGE FLOATING BARGE FOR EXAMPLE FOR PROCESSING GAS OR CRUDE OIL AT SEA

(75) Inventors: Pierre-Armand Thomas, Puteaux (FR); Jean-Marc Cholley, Saint-Leu-la-Forêt (FR)

(73) Assignee: Technip France (FR)

( * ) Notice: Subject to any disclaimer, the term of this patent is extended or adjusted under 35 U.S.C. 154(b) by 338 days.

(21) Appl. No.: 12/867,536

(22) PCT Filed: Feb. 9, 2009

(86) PCT No.: PCT/FR2009/050203

§ 371 (c)(1),
(2), (4) Date: Oct. 19, 2010

(87) PCT Pub. No.: WO2009/101351

PCT Pub. Date: Aug. 20, 2009

(65) Prior Publication Data

US 2011/0036286 A1 Feb. 17, 2011

(30) Foreign Application Priority Data

Feb. 14, 2008 (FR) ..... 08 50954

(51) Int. Cl.
*B63B 9/00* (2006.01)

(52) U.S. Cl.
USPC ..... 114/65 R; 114/264

(58) Field of Classification Search
USPC ..... 114/65 R, 77 A, 77 R, 264, 265, 355
See application file for complete search history.

(56) References Cited

U.S. PATENT DOCUMENTS

| | | | | |
|---|---|---|---|---|
| 3,874,314 | A | 4/1975 | Sanders | |
| 4,166,426 | A * | 9/1979 | Lloyd, III | 114/65 R |
| 4,227,828 | A * | 10/1980 | Ivanov et al. | 114/65 R |
| 5,325,805 | A * | 7/1994 | Howson | 114/77 A |
| 6,761,124 | B1 | 7/2004 | Srinivasan | |

FOREIGN PATENT DOCUMENTS

WO WO 03/064245 A 8/2003

OTHER PUBLICATIONS

International Search Report dated Sep. 10, 2009, issued in corresponding international application No. PCT/FR2009/050203.

* cited by examiner

*Primary Examiner* — Lars A Olson
(74) *Attorney, Agent, or Firm* — Ostrolenk Faber LLP

(57) ABSTRACT

The present disclosure relates to a method of assembling and installing a very large floating barge (1) and includes manufacturing each side portion (10) and each connection portion (15) separately, placing each side portion (10) on the water, moving the connection portions (15) between the side portions (10), moving the connection portions (15) vertically, fixing the connection portions (10) to the side portions (15) and taking the barge (1) to the operation site.

1 Claim, 6 Drawing Sheets

METHOD OF ASSEMBLING AND INSTALLING A VERY LARGE FLOATING BARGE FOR EXAMPLE FOR PROCESSING GAS OR CRUDE OIL AT SEA

CROSS REFERENCE TO RELATED APPLICATIONS

The present application is a 35 U.S.C. §371 National Phase conversion of PCT/FR2009/050203, filed Feb. 9, 2009, which claims benefit of French Application No. 08 50954, filed Feb. 14, 2008, the disclosure of which is incorporated herein by reference. The PCT International Application was published in the French language.

BACKGROUND OF THE INVENTION

The present invention relates to a method of assembling and installing a very large floating barge for example for processing gas or crude oil at sea.

After the gas or crude oil has been extracted, a product of this type requires numerous processing stages and large, heavy equipment and installations.

When the crude oil or gas is extracted at sea, this equipment and these installations are placed on floating storage or FPSO—Floating Production Storage and Offloading—units. This term refers to a ship or floating unit such as a barge used for production at sea. This type of floating unit receives the crude oil or gas extracted from the production location and stores and processes the production until a ship, such as a petrol tanker, can load it by means of a buoy situated some hundreds of meters from the floating unit and take the production to a port.

The floating unit also has numerous systems for processing and separating the different types of crude oil or gas and accommodation units, together with a dynamic positioning system when weather conditions are unfavourable.

The largest floating units produced are about 310 meters long, about 60 meters wide and about 30 meters high. They may have a production capacity of over 200,000 barrels a day and a storage capacity of 2 million barrels.

At the moment, very large floating units cannot be built at existing construction sites.

In fact, construction sites for these floating units have dry docks and quays of limited capacity which do not allow the construction of very long hulls over 310 meters long or very wide hulls over 60 meters wide.

SUMMARY OF THE INVENTION

The object of the invention is to propose a method of assembling and installing a very large floating barge which solves problem of limited construction site manufacturing capacity.

The object of the invention is also a method of assembling and installing a very large floating barge of the type comprising two opposite single-piece side portions connected to one another by connection portions arranged between said side portions, characterised in that it comprises the following successive steps:

- each side portion is manufactured in a single piece and each connection portion is manufactured separately on an assembly quay,
- each side portion is placed on the water close to this quay,
- the two side portions are held floating opposite one another,
- the connection portions are moved between the two side portions by at least one transport barge,

- the connection portions are moved vertically until the upper face of the connection portions is level with the upper face of the side portions,
- the connection portions are fixed to the side portions,
- the at least one transport barge is withdrawn, and
- the barge is floated to the operation site.

The invention will be better understood on reading the following description, which is given as an example with reference to the accompanying drawings, in which:

BRIEF DESCRIPTION OF THE DRAWINGS

FIG. 1 shows, seen from above, a very large floating barge designated in its entirety by the reference numeral 1.

Figure 1:
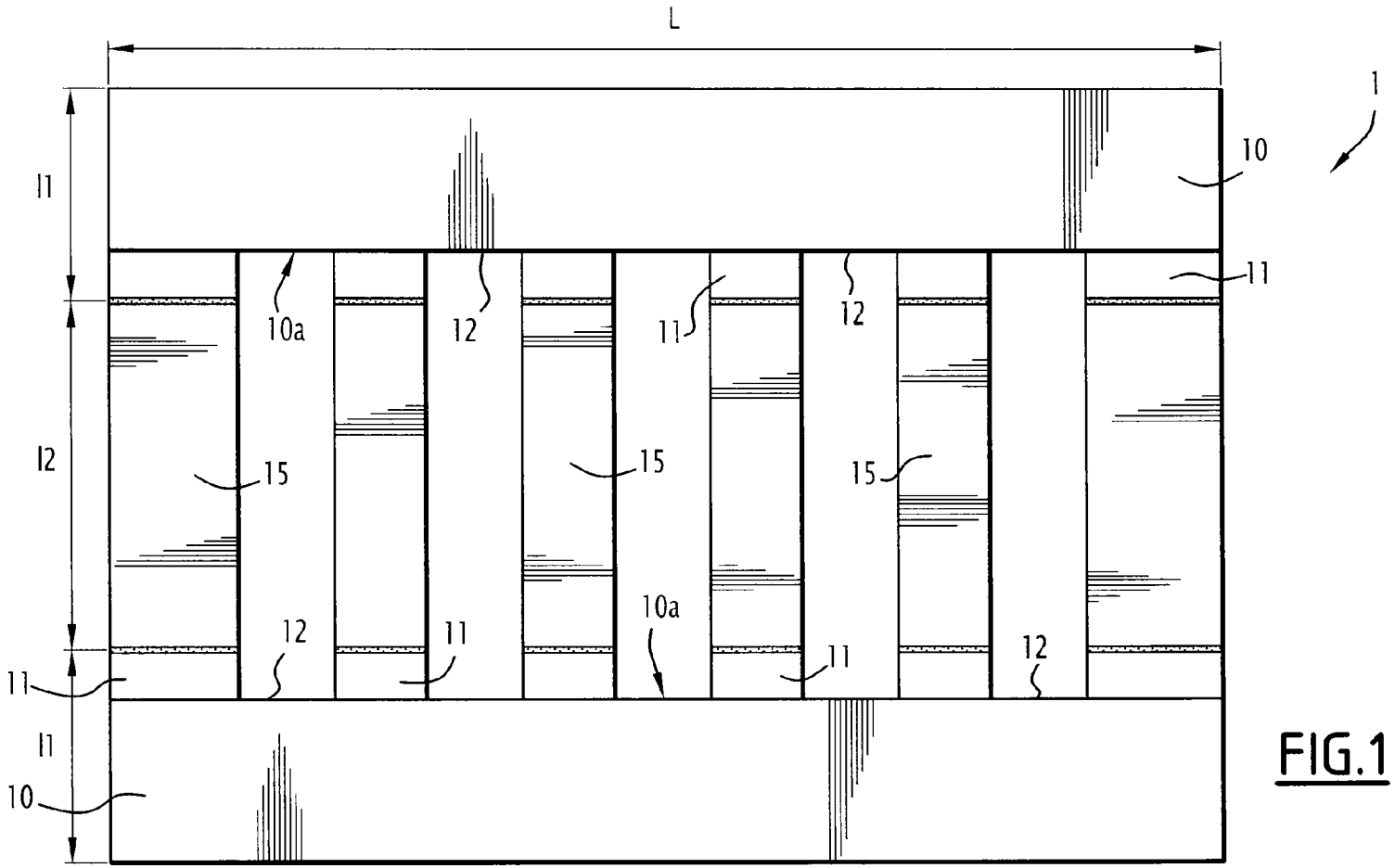
FIG. 1 is a diagrammatic view from above of a floating barge.

In the rest of this document, the barge 1 described will be a barge for processing gas or crude oil at sea. Clearly, this floating barge may be used in other fields.

The barge 1 has a generally quadrilateral shape comprising two opposite single-piece side portions 10. The inner wall **10*a* of each side portion 10 comprises a succession of projecting portions 11 separated by hollow portions 12**.

The barge 1 also comprises connection portions 15 extending crosswise relative to the side portions 10 and fixed between two projecting portions 11 of the two opposite side portions 10.

The connection portions 15 are connected to the side portions 10 for example by welding or any other appropriate known means.

As a non-limiting example, the length L of the barge 1 is more than 300 meters and preferably approximately 310 meters and the width 11 of each side portion 10 is about 50 meters. The width 12 of each connection portion 15 is at least 50 meters which gives a total width for the barge 1 of at least 150 meters.

Referring now to FIGS. 2 to 7, the construction and assembly of the various portions 10 and 15 making up the barge 1 will be described.

Figure 2:
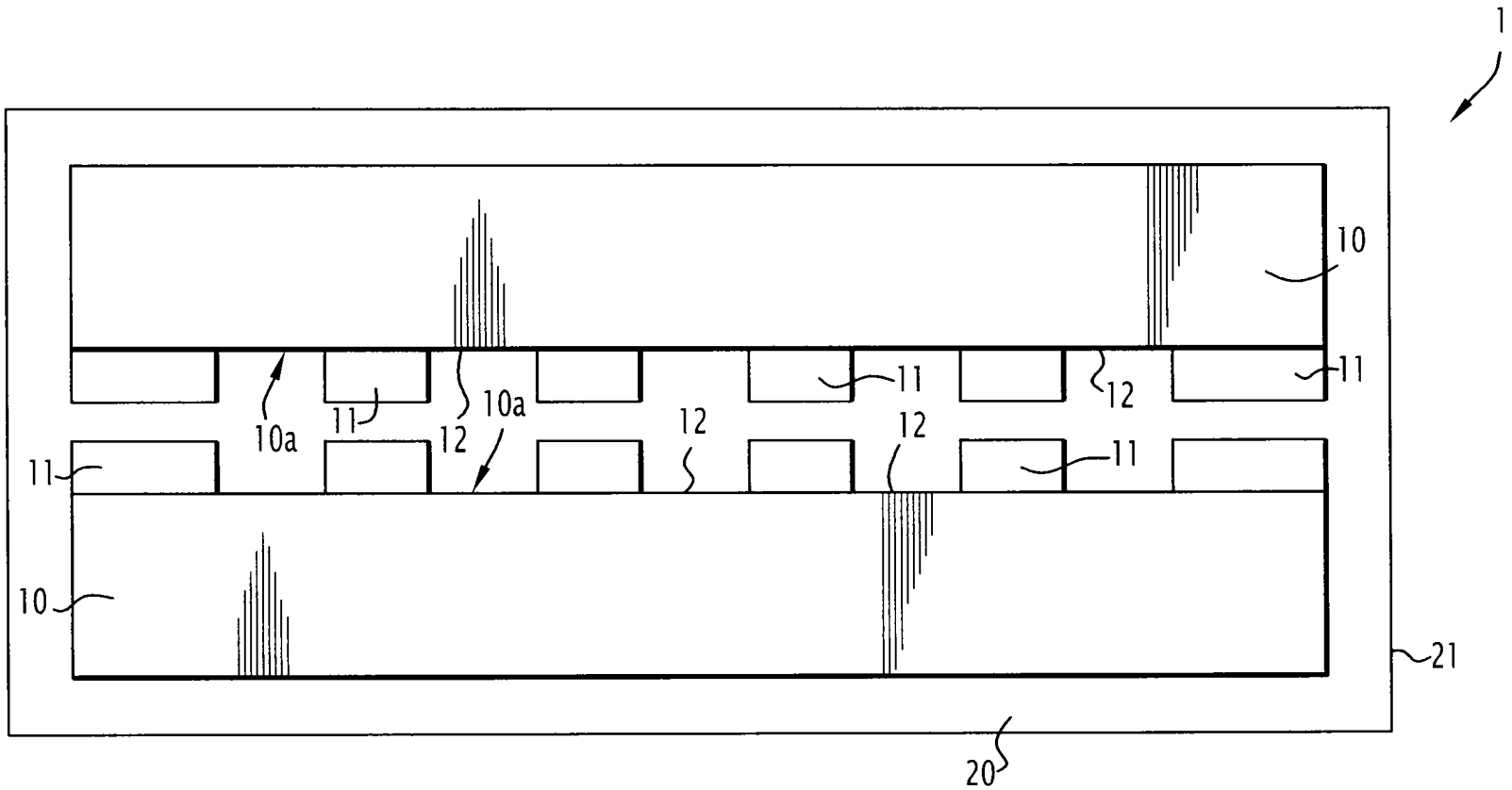
FIGS. 2 to 7 are diagrammatic views from above or from the side showing the different assembly and installation stages of the floating barge.
Figure 3:
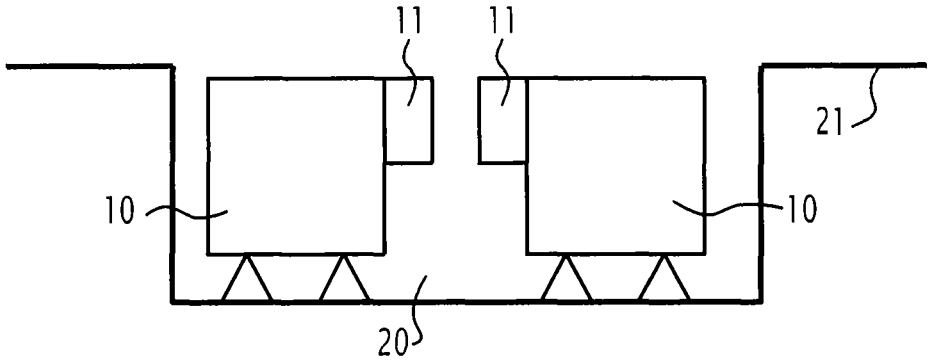

As shown in FIGS. 2 and 3, the side portions 10 are manufactured separately, for example in a dry dock 20 of an assembly quay 21 and the connection portions 15 are also manufactured independently of one another.

Figure 4:
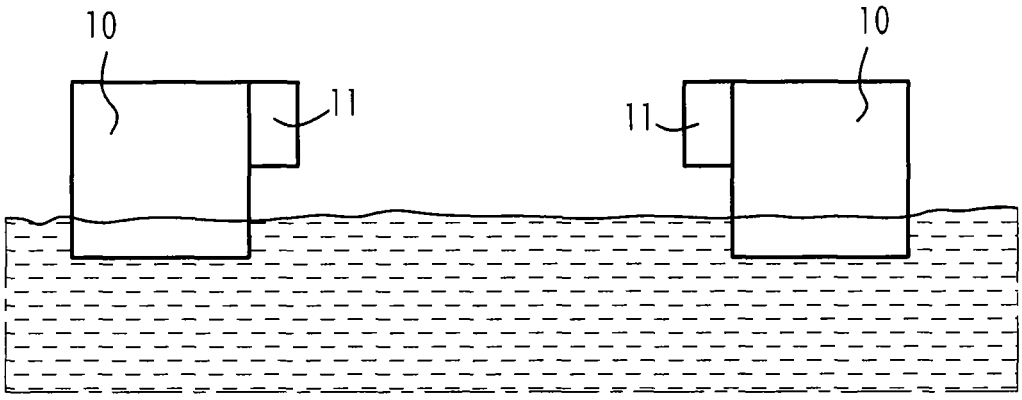

When the various side 10 and connection 15 portions have been manufactured, the two side portions 10 are launched as shown in FIG. 4 and held floating opposite one another by appropriate means, not shown.

Figure 5:
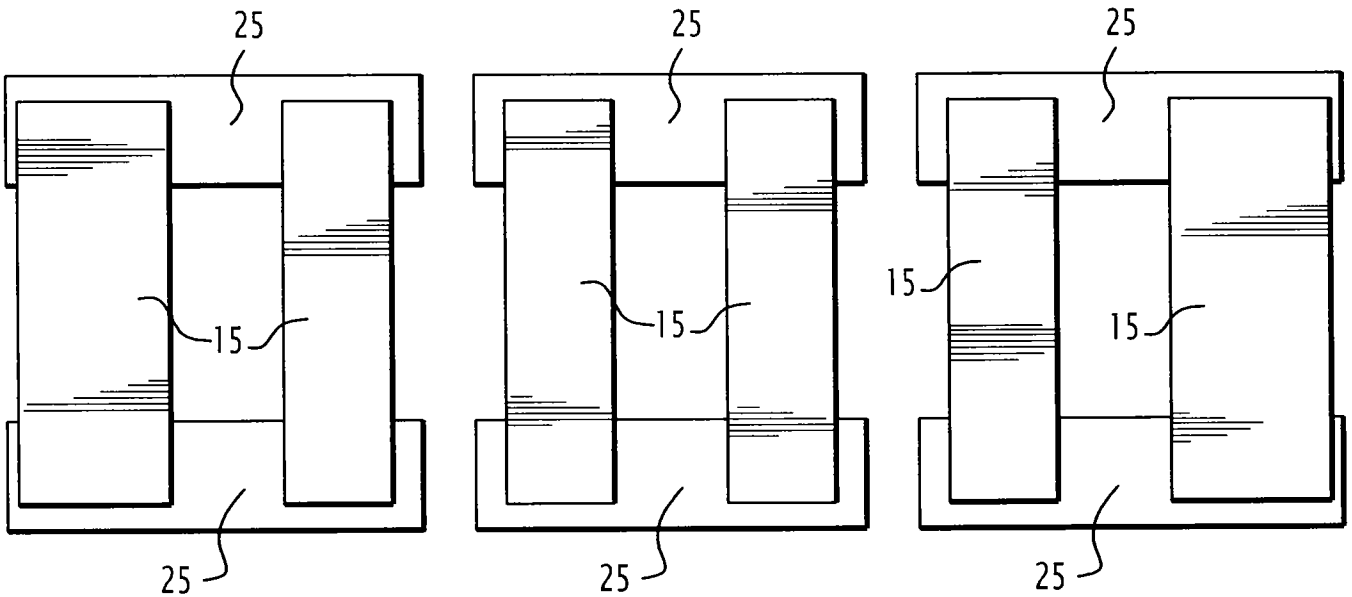
Figure 6:
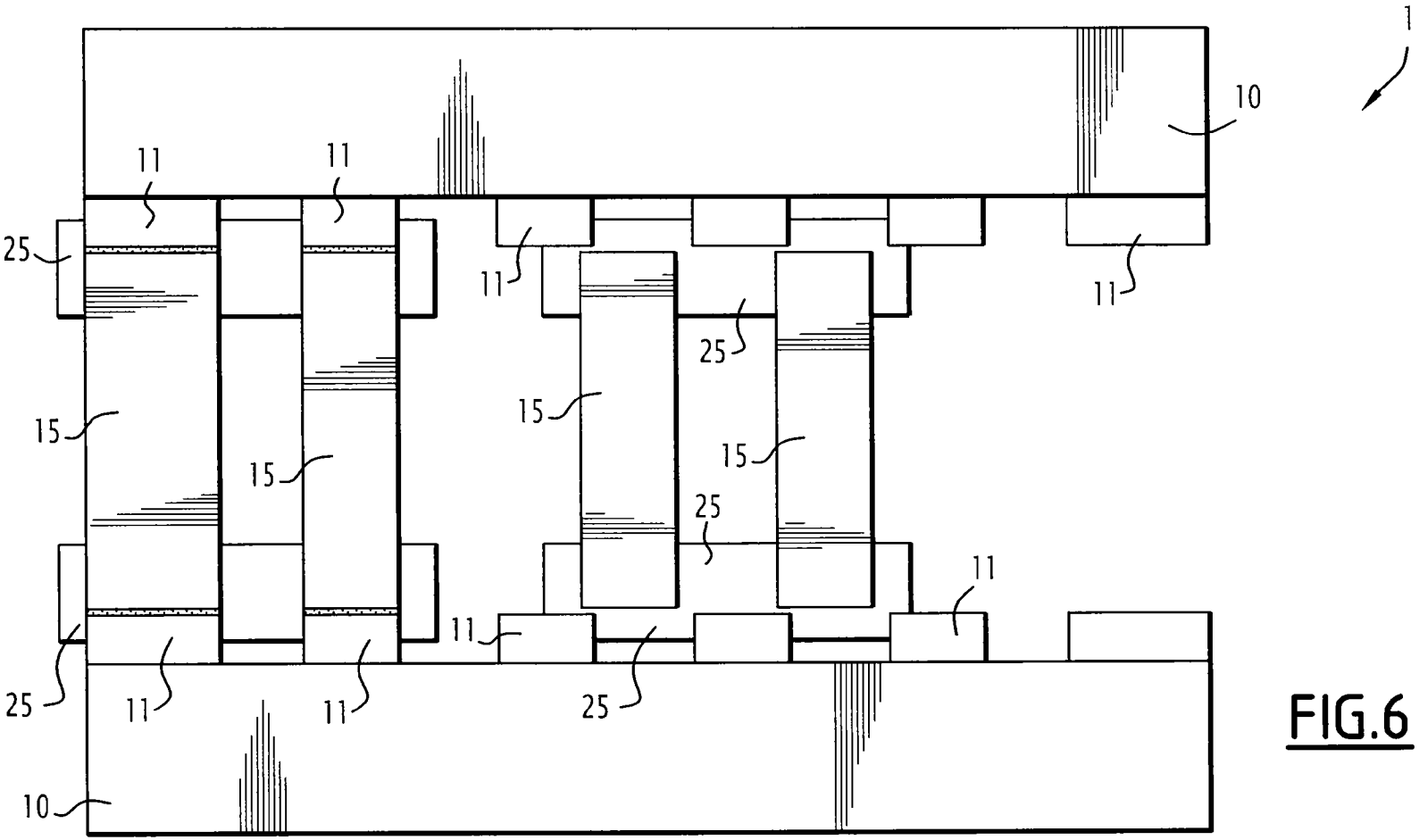

Next, the connection portions 15 are placed on at least one transport barge 25 and preferably two connection portions 15 are placed on two transport barges 25, as shown in FIG. 5. In a variant, all the connection portions 15 may be transported by a single transport barge 25.

In this way, the connection portions 15 are moved in pairs between the side portions 10 and are fixed, for example by welding or any other appropriate known means, between the two side portions 10.

Figure 7:
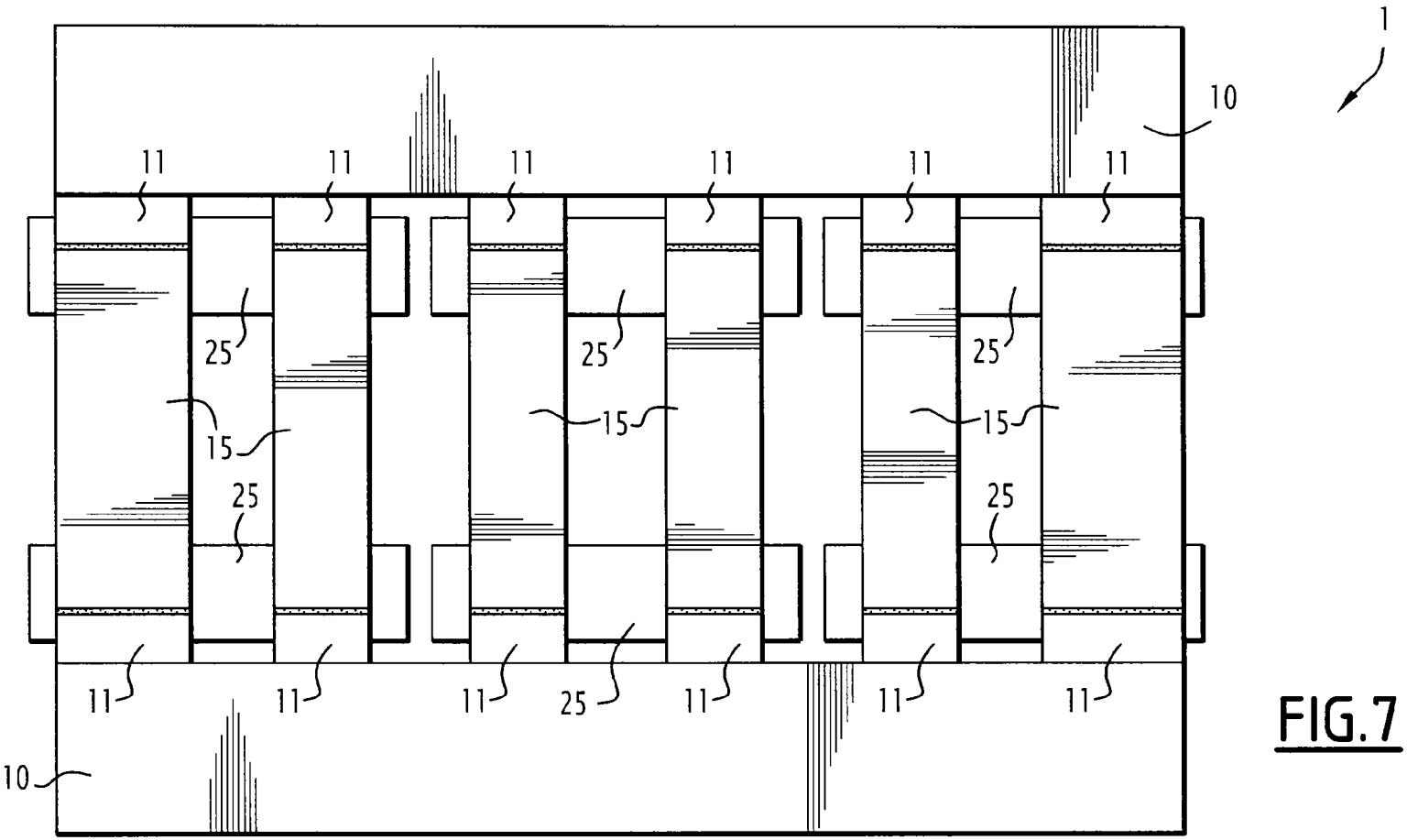

To do this, the upper face of each of the connection portions 15 is moved vertically by any appropriate means, such as ballasting or deballasting the transport barges 25, until they are level with the upper face of the side portions 11. After having fixed all the connection portions 15 between the side portions 10, as shown in FIG. 7, the transport barges are withdrawn by ballasting them.

Once the various operations for assembling the side portions 10 and connection portions 15 have been performed in this way, the barge 1 is floated to a quay so that all the processing units and modules together with the accommodation units manufactured previously on said quay can be installed on said barge.

Before this, a floor, not shown, is installed on the connection portions 15 to fill the gaps between these portions and thus form a continuous planar surface.

According to a first method, the units or modules and the accommodation units are transferred from the quay onto the barge 1 by lifting devices, such as cranes.

According to a second method, the upper surface of the barge 1 is moved level with the quay, and the processing units or modules together with the accommodation units are transferred to the barge 1 by sliding them from the quay 21 onto said barge 1.

The barge 1 thus equipped is floated to the operation site.

The side 10 and crosswise 15 portions form tanks for storing the processed gas and/or crude oil. The processed gas or crude oil is then transferred to a transport ship, such as an oil tanker, by means of a buoy situated some kilometers from the barge 1.

The assembly and installation method for this type of very large barge according to the invention simplifies assembly operations in small- or standard-size dry docks or quays and thus reduces manufacturing costs. Because of the large dimensions of the barge, the various equipment and installations required to process the gas or crude oil extracted at sea can be brought together on the same platform.

The invention claimed is:

1. A method of assembling and installing a floating barge, wherein the barge comprises two opposite, single piece, side portions and connection portions connecting the side portions to one another and arranged between the side portions, the method comprising:

manufacturing each of the side portions as a separate single piece in an assembly quay, and manufacturing the connection portions separately from the side portions;

placing each side portion on water, close to the assembly quay, and holding the two side portions floating opposite one another;

moving the connection portions between the two floating side portions by use of at least one floating transport vessel;

then moving the connection portions vertically until an upper face thereof is level with an upper face of the floating side portions;

then fixing the connection portions to the floating side portions;

then withdrawing the at least one floating transport vessel away from the connection portions; and floating the barge to an operation site.

* * * * *

UNITED STATES PATENT AND TRADEMARK OFFICE

CERTIFICATE OF CORRECTION

PATENT NO. : 8,567,330 B2
APPLICATION NO. : 12/867536
DATED : October 29, 2013
INVENTOR(S) : Thomas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 402 days.

Signed and Sealed this
Fifteenth Day of September, 2015

Michelle K. Lee

Michelle K. Lee
*Director of the United States Patent and Trademark Office*